US009445692B2

(12) United States Patent
Hunt

(10) Patent No.: US 9,445,692 B2
(45) Date of Patent: Sep. 20, 2016

(54) BATHING FACILITY CUSHION DEVICE

(71) Applicant: Derwin Hunt, LaGrange, KY (US)

(72) Inventor: Derwin Hunt, LaGrange, KY (US)

( * ) Notice: Subject to any disclaimer, the term of this patent is extended or adjusted under 35 U.S.C. 154(b) by 223 days.

(21) Appl. No.: 14/328,220

(22) Filed: Jul. 10, 2014

(65) Prior Publication Data

US 2016/0007808 A1 Jan. 14, 2016

(51) Int. Cl.
*A47K 3/00* (2006.01)
*A47K 1/08* (2006.01)
*A47K 3/12* (2006.01)

(52) U.S. Cl.
CPC ..... *A47K 3/001* (2013.01); *A47K 1/08* (2013.01); *A47K 3/125* (2013.01)

(58) Field of Classification Search
CPC ..... A47K 1/08; A47K 3/001; A47K 3/002; A47K 3/12; A47K 3/122; A47K 3/125; A47K 3/127; A45D 44/10; A61G 2007/0522
USPC ..... 4/515, 519, 523, 559, 571.1, 573.1, 4/575.1, 576.1, 577.1, 579, 580, DIG. 18; 5/630, 636, 642, 643, 646; 297/219.1, 297/220, 225, 227, 228, 228.13, 229
See application file for complete search history.

(56) References Cited

U.S. PATENT DOCUMENTS 1,006,381 A * 10/1911 Hess ..... A47K 3/001 297/230.12
1,329,487 A * 2/1920 West ..... A47K 3/003 296/153
1,650,743 A * 11/1927 Seckbach ..... A47K 3/125 4/575.1
1,998,987 A * 4/1935 Francis ..... A47K 3/003 4/577.1
2,948,903 A * 8/1960 Gilmer ..... A45D 19/10 4/523
4,327,452 A * 5/1982 Swatzell ..... A45D 44/10 4/515
4,385,408 A * 5/1983 Rhodes ..... A47K 1/08 4/515
4,937,897 A 7/1990 Barnabie
5,193,487 A 3/1993 Vogel
5,313,675 A 5/1994 Tinen
5,551,101 A 9/1996 Leach
5,771,506 A * 6/1998 Joiner ..... A47C 21/08 297/219.1
6,453,485 B2 9/2002 Bullock
6,925,660 B1 8/2005 Cartwright
2006/0288477 A1* 12/2006 Kerley ..... A47K 3/001 4/559
2008/0148472 A1 6/2008 Cline et al.
2013/0161997 A1* 6/2013 Ciepiela ..... A47C 7/38 297/399

* cited by examiner

*Primary Examiner* — J. Casimer Jacyna

(57) ABSTRACT

A bathing facility cushion device protects a person from impact damage in the event of an accident incident to bathing. The device includes an elongated resilient retainer and an elongated pad. An inner section and an outer section of the retainer define a channel therebetween. The channel tapers extending away from a medial section of the retainer. A first section and a second section of the pad define a passage therebetween. The pad is enageable to the retainer wherein the retainer is configured for securing the pad over a top surface of a side wall of a bathtub such that the first section and the second section extend downwardly along the side wall of the bathtub.

11 Claims, 4 Drawing Sheets

BATHING FACILITY CUSHION DEVICE

BACKGROUND OF THE DISCLOSURE

Field of the Disclosure

The disclosure relates to cushion devices and more particularly pertains to a new cushion device for protecting a person from impact damage in the event of an accident incident to bathing.

SUMMARY OF THE DISCLOSURE

An embodiment of the disclosure meets the needs presented above by generally comprising an elongated resilient retainer and an elongated pad. An inner section and an outer section of the retainer define a channel therebetween. The channel tapers extending away from a medial section of the retainer. A first section and a second section of the pad define a passage therebetween. The pad is enageable to the retainer wherein the retainer is configured for securing the pad over a top surface of a side wall of a bathtub such that the first section and the second section extend downwardly along the side wall of the bathtub.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
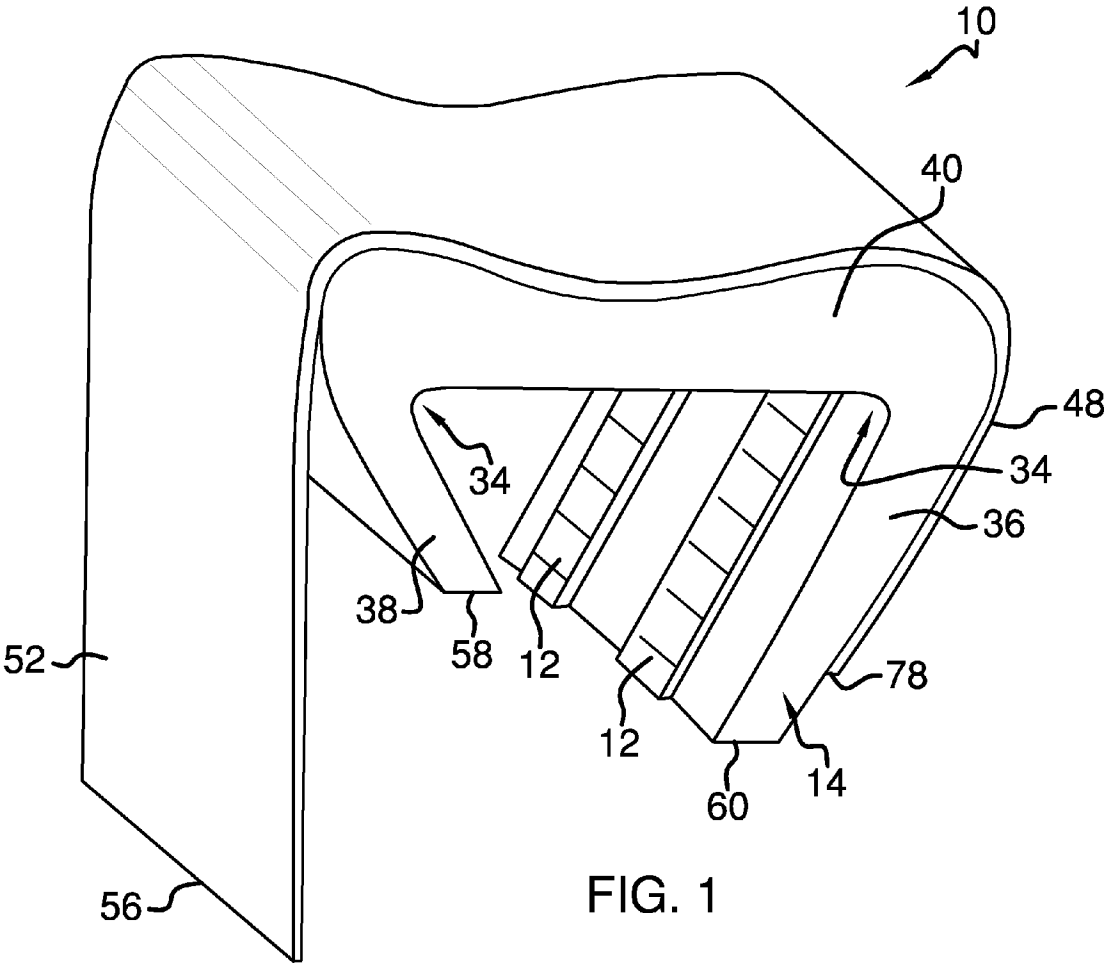
FIG. 1 is a top front side perspective view of a bathing facility cushion device according to an embodiment of the disclosure.
Figure 2:
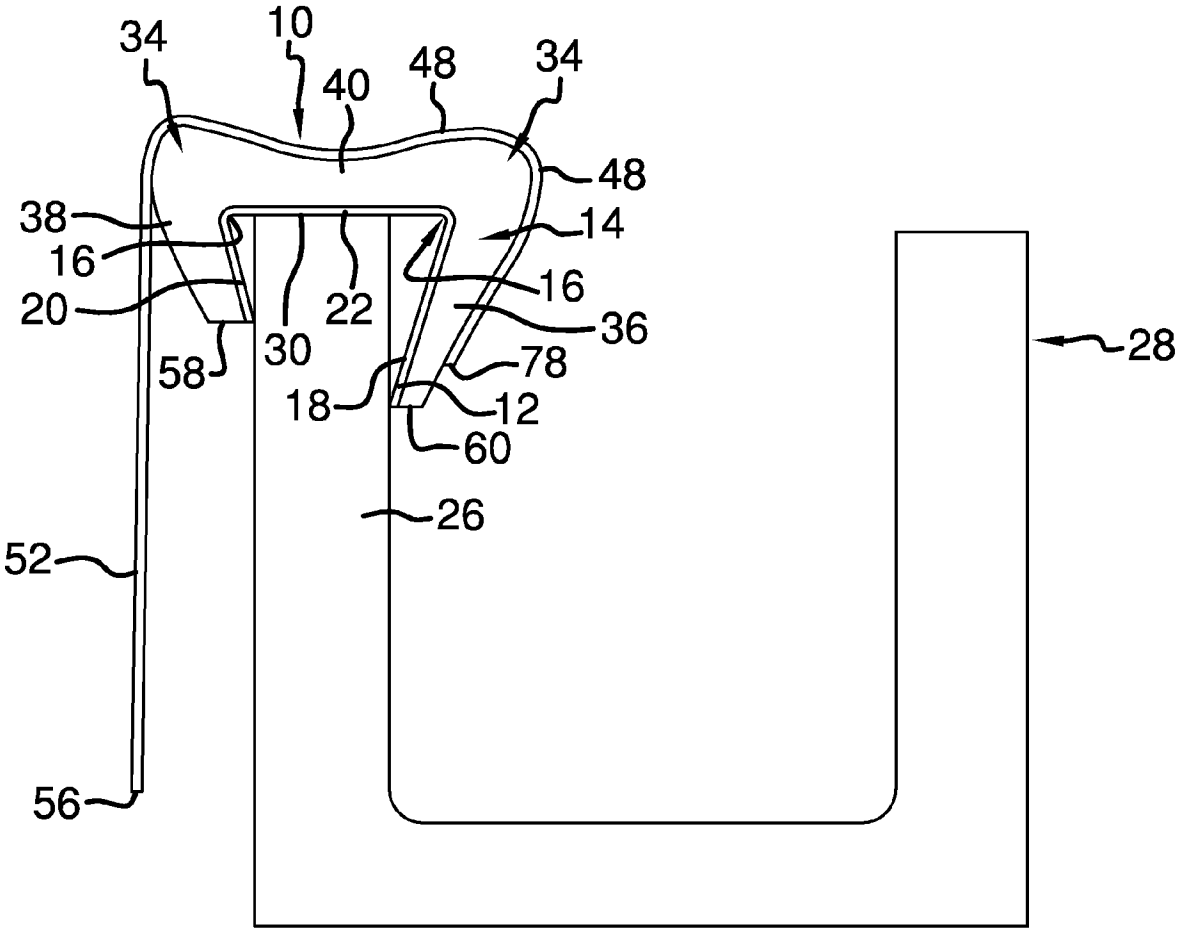
FIG. 2 is an end view of an embodiment of the disclosure coupled to a bathtub.
Figure 3:
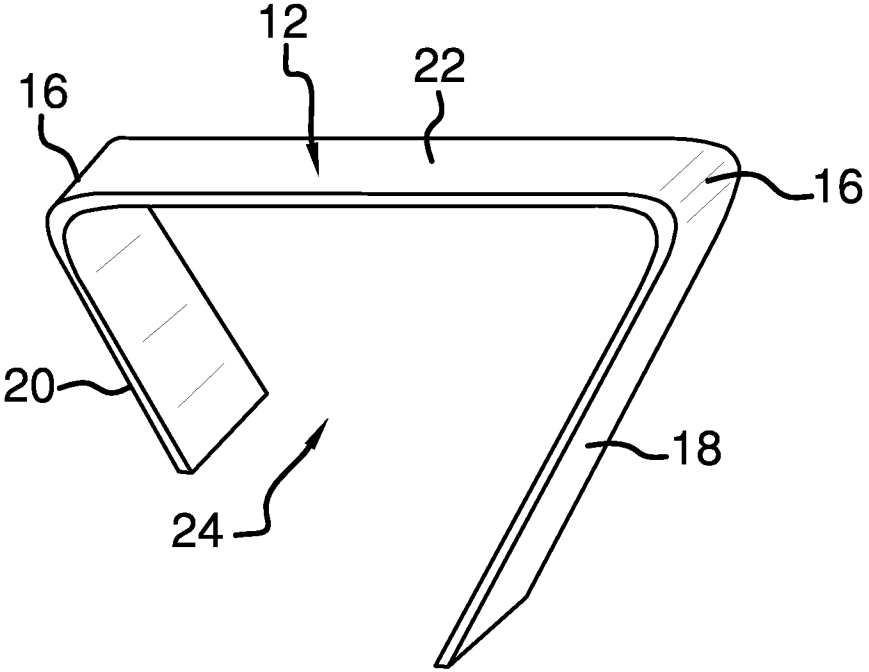
FIG. 3 is a top back side perspective view of a pad of an embodiment of the disclosure.
Figure 4:
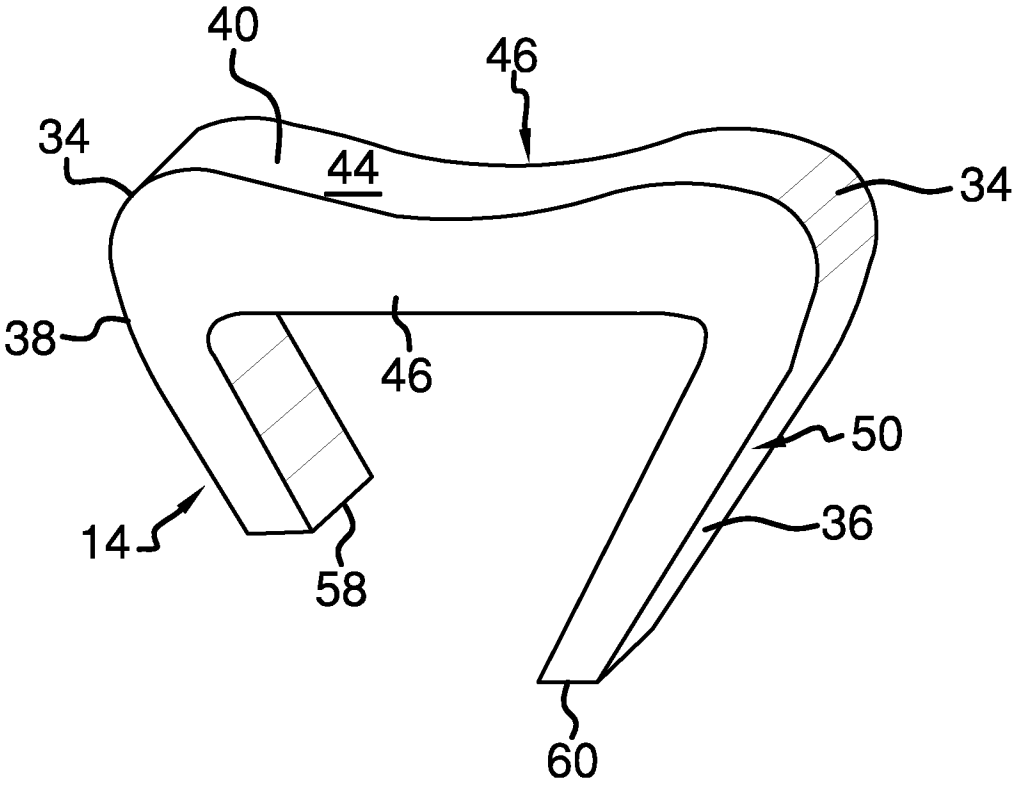
FIG. 4 is a top back side perspective view of a retainer of an embodiment of the disclosure.

With reference now to the drawings, and in particular to FIGS. 1 through 4 thereof, a new cushion device embodying the principles and concepts of an embodiment of the disclosure and generally designated by the reference numeral 10 will be described.

As best illustrated in FIGS. 1 through 4, the bathing facility cushion device 10 generally comprises a pair of retainers 12 and a pad 14. Each retainer 12 is elongated. Each retainer 12 comprises a pair of bends 16 defining an inner section 18, an outer section 20 and a medial section 22 extending between the inner section 18 and the outer section

20 of each retainer 12. The inner section 18 and the outer section 20 of each retainer 12 defining a respective channel 24 therebetween. Each of the inner section 18 and the outer section 20 of each retainer 12 extends from the medial section 22 such that the channel 24 tapers extending away from the medial section 22. Each retainer 12 is constructed of a resilient material such as plastic, metal, alloy, plastic covered metal, or the like, such that each retainer 12 is resilient when deformed. The inner section 18 and the outer section 20 are thus configured for frictionally engaging a side wall 26 of a bathtub 28 when the medial section 22 of each retainer 12 abuts a top surface 30 of the side wall 26 of the bathtub 28. A length of the inner section 18 of each retainer 12 is greater than a length of the outer section 20 of the retainer 12 such that the inner section extends downwardly into the bathtub 28.

The pad 14 is also elongated. The pad 14 comprises a pair of curves 34 defining a first section 36, a second section 38, and a middle section 40 extending between the first section 36 and the second section 38. The first section 36 and the second section 38 define a passage 42 therebetween. The pad 14 is enageable to each retainer 12 in a conventional manner and may be affixed to the retainers 12 by an adhesive or the like. The retainers 12 are configured for securing the pad 14 over the top surface 30 of the side wall 26 of the bathtub 28 such that the first section 36 and the second section 38 extend downwardly along the side wall 26 of the bathtub 28. The middle section 40 of the pad 14 has an upper surface 44. The upper surface 44 is concave extending between the first section 36 and the second section 38 of the pad 14. The upper surface 44 has a consistent curvature across the middle section 40 parallel to each of the lateral sides 46 of the middle section 40. A length of the first section 36 of the pad 14 is equal to a length of the inner section 18 of each retainer 12. A length of the second section 38 of the pad 14 is equal to a length of the outer section 20 of each retainer 12. The pad 14 has a width such that the retainers 12 are couplable to the pad 14 in parallel spaced relationship within the passage 42. The pad 14 has a pair of lateral surfaces 46. Each of the lateral surfaces 46 of the pad 14 is positioned in outwardly spaced relationship to an outer edge 48 of a respective one of the retainers 12. Thus, the retainers 12 are inset from the lateral surfaces 46 preventing direct contact with the retainers 12 during use of the bathtub 28.

A cloth 48 is couplable to an exterior surface 50 of the first section 36 of the pad 14. The cloth 48 has a length such that the cloth 48 is extendable over the middle section 40 of the pad 14 and a distal section 52 of the cloth 48 relative to the first section 36 of the pad 14 is free to hang down from the middle section 40 proximate the second section 38 of the pad 14. The cloth 48 may be affixed to the pad 14 using conventional adhesive or may be removably coupled to allow for periodic cleaning of the cloth 48. A distal edge 56 of the cloth 48 relative to the first section 36 of the pad 14 is vertically spaced below a bottom edge 58 of the second section 38 of the pad 14 when the cloth 48 is coupled to the pad 14. A proximal edge 78 of the cloth 48 relative to the first section 36 of the pad 14 is offset from a bottom edge 60 of the first section 36 of the pad 14 wherein a lower portion 62 of the exterior surface 50 of the first section 36 is exposed between the proximal edge 78 of the cloth 48 and the bottom edge 60 of the first section 36 of the pad 14.

Each retainer 12 may have a width between 3 and 7 centimeters. The width of the pad 14 is between 12 and 18 centimeters. The depth of the curvature into the upper surface 44 is between 1 and 2 centimeters. The length of the first section 36 of the pad 14 is between 7 and 10 centimeters. The length of the second section 38 of the pad 14 is between 4 and 6 centimeters.

In use, the retainers 12 and pad 14 are positioned on the side wall 26 of the bathtub 28 at a desired position. The pad 14 and retainers 12 may be sized for variously sized bathtubs. The cloth 48 inhibits slipping on the pad 14 while the pad 14 protects against impacting the side wall 26 of the bathtub 28.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bathing facility cushion device comprising:

a retainer, said retainer being elongated, said retainer comprising a pair of bends defining an inner section, an outer section and a medial section extending between said inner section and said outer section, said inner section and said outer section defining a channel therebetween, each of said inner section and said outer section extending from said medial section such that said channel tapers extending away from said medial section, said retainer being resilient wherein said inner section and said outer section are configured for frictionally engaging a side wall of a bathtub when said medial section of said retainer abuts a top surface of the side wall of the bathtub;

a pad, said pad being elongated, said pad comprising a pair of curves defining a first section, a second section, and a middle section extending between said first section and said second section, said first section and said second section defining a passage therebetween, said pad being enageable to said retainer wherein said retainer is configured for securing said pad over the top surface of the side wall of the bathtub such that said first section and said second section extend downwardly along the side wall of the bathtub; and a cloth, said cloth being couplable to an exterior surface of said first section of said pad, said cloth having a length such that said cloth is extendable over said middle section of said pad and a distal section of said cloth relative to said first section of said pad is free to hang down from said middle section proximate said second section of said pad.

2. The device of claim 1, further comprising a length of said inner section of said retainer being greater than a length of said outer section of said retainer.

3. The device of claim 1, further comprising a length of said first section of said pad being equal to a length of said inner section of said retainer.

4. The device of claim 1, further comprising a length of said second section of said pad being equal to a length of said outer section of said retainer.

5. The device of claim 1, further comprising said middle section of said pad having an upper surface, said upper surface being concave extending between said first section and said second section of said pad.

6. The device of claim 1, further comprising said retainer being one of a pair of said retainers, said pad having a width such that said retainers are couplable to said pad in parallel spaced relationship within said passage.

7. The device of claim 6, further comprising said pad having a pair of lateral surfaces, each of said lateral surfaces of said pad being positioned in outwardly spaced relationship to an outer edge of a respective one of said retainers.

8. The device of claim 1, further comprising a distal edge of said cloth relative to said first section of said pad being vertically spaced below a bottom edge of said second section of said pad when said cloth is coupled to said pad.

9. The device of claim 1, further comprising said medial section of said retainer being planar.

10. The device of claim 1, further comprising a proximal edge of said cloth relative to said first section of said pad being offset from a bottom edge of said first section of said pad wherein a lower portion of said exterior surface of said first section is exposed between said proximal edge of said cloth and said bottom edge of said first section of said pad.

11. A bathing facility cushion device comprising:

a pair of retainers, each said retainer being elongated, each said retainer comprising a pair of bends defining an inner section, an outer section and a medial section extending between said inner section and said outer section of each said retainer, said inner section and said outer section of each said retainer defining a respective channel therebetween, each of said inner section and said outer section of each said retainer extending from said medial section such that said channel tapers extending away from said medial section, each said retainer being resilient wherein said inner section and said outer section are configured for frictionally engaging a side wall of a bathtub when said medial section of each said retainer abuts a top surface of the side wall of the bathtub, a length of said inner section of each said retainer being greater than a length of said outer section of said retainer;

a pad, said pad being elongated, said pad comprising a pair of curves defining a first section, a second section, and a middle section extending between said first section and said second section, said first section and said second section defining a passage therebetween, said pad being enageable to said retainer wherein said retainer is configured for securing said pad over the top surface of the side wall of the bathtub such that said first section and said second section extend downwardly along the side wall of the bathtub, said middle section of said pad having an upper surface, said upper surface being concave extending between said first section and said second section of said pad, a length of said first section of said pad being equal to a length of said inner section of said retainer, a length of said second section of said pad being equal to a length of said outer section of said retainer, said pad having a width such that said retainers are couplable to said pad in parallel spaced relationship within said passage, said pad having a pair of lateral surfaces, each of said lateral surfaces of said pad being positioned in outwardly spaced relationship to an outer edge of a respective one of said retainers; and a cloth, said cloth being couplable to an exterior surface of said first section of said pad, said cloth having a length such that said cloth is extendable over said middle section of said pad and a distal section of said cloth relative to said first section of said pad is free to hang down from said middle section proximate said second section of said pad, a distal edge of said cloth relative to said first section of said pad being vertically spaced below a bottom edge of said second section of said pad when said cloth is coupled to said pad, a proximal edge of said cloth relative to said first section of said pad being offset from a bottom edge of said first section of said pad wherein a lower portion of said exterior surface of said first section is exposed between said proximal edge of said cloth and said bottom edge of said first section of said pad.

* * * * *